US008160479B2

(12) United States Patent
Oki

(10) Patent No.: US 8,160,479 B2
(45) Date of Patent: Apr. 17, 2012

(54) IMAGE FORMING APPARATUS INCLUDING CORONA CHARGER

(75) Inventor: Shigeru Oki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 12/815,617

(22) Filed: Jun. 15, 2010

(65) Prior Publication Data

US 2010/0322665 A1 Dec. 23, 2010

(30) Foreign Application Priority Data

Jun. 19, 2009 (JP) ..... 2009-146817
Jun. 14, 2010 (JP) ..... 2010-135537

(51) Int. Cl.
*G03G 15/00* (2006.01)

(52) U.S. Cl. ..... 399/126; 399/11; 399/115; 399/170

(58) Field of Classification Search ..... 399/9, 11, 399/15, 31, 38, 50, 72, 75, 107, 115, 126, 399/168, 170–172
See application file for complete search history.

(56) References Cited

U.S. PATENT DOCUMENTS 5,339,137 A 8/1994 Kusumoto et al.
2006/0120742 A1 * 6/2006 Kodama et al. ..... 399/49

FOREIGN PATENT DOCUMENTS

JP 6-102740 A 4/1994

* cited by examiner

*Primary Examiner* — David Porta
*Assistant Examiner* — Benjamin Schmitt
(74) *Attorney, Agent, or Firm* — Fitzpatrick, Cella, Harper & Scinto

(57) ABSTRACT

An image forming apparatus includes a photosensitive member; a corona charger provided with a discharging wire for electrically charging the photosensitive member; an exposure device for exposing to light the photosensitive member; a developing device for developing the electrostatic image; a transfer device for transferring the toner image onto a sheet; an adjusting device for adjusting a distance from the discharging wire to the photosensitive member; a detecting device for detecting information corresponding to a surface potential of the photosensitive member at least two points; and an executing device configured to execute an operation in a mode in which an image including a reference mark positioned at a reference portion of said corona charger, for adjusting the position of the discharging wire by the adjusting mechanism and an adjusting mark for adjusting a distance of the discharging wire from the photosensitive member.

4 Claims, 10 Drawing Sheets

IMAGE FORMING APPARATUS INCLUDING CORONA CHARGER

FIELD OF THE INVENTION AND RELATED ART

The present invention relates to an electrophotographic image forming apparatus such as a printer or a copying machine. Especially, the present invention relates to the image forming apparatus including a mechanism for adjusting a height of a discharge wire of a corona charger.

In a conventional electrophotographic image forming apparatus, as a charging means for electrically charging a surface of photosensitive drum uniformly, the corona charger using the discharge wire has been used.

This discharge wire is renewed (replaced) in the market (a place where the image forming apparatus is disposed) due to contamination thereafter the end of its lifetime. However, by a renewing operation of the discharge wire, a state of gradation in density with respect to a direction of a halftone image from a rear side to a front side with respect to a photosensitive drum axis (shaft) direction, i.e., a rear-front direction is changed. For this reason, every renewing operation, the gradation in density has been adjusted by adjusting the height of the discharge wire with respect to the rear-front direction.

For example, Japanese Laid-Open Patent charger capable of adjusting the discharge wire height (FIG. 15). Specifically, by moving a contact member 197 forward and rearward, a base portion 195*a*' of a slider 195' moves a taper 197*a* relative thereto, so that the height of a discharge wire 192 is adjusted.

The density gradation state of the halftone image with respect to the rear-front direction (a longitudinal direction of the corona charger) is also influenced by a status of use (the number of sheets subjected to image formation). Further, also by replacement of the photosensitive drum with a new one in the market, the density gradation state of the halftone image with respect to the rear-front direction is changed due to a gradient of sensitivity of the photosensitive drum with respect to the axis direction (generating line direction) of the photosensitive drum. For this reason, there was need to frequently adjust the height of the discharge wire.

A conventional height adjusting procedure (height adjusting process) of the discharge wire will be described. First, a service person (operator) operated the image forming apparatus to output the halftone image on a recording sheet. Then, the service person adjusted a height position of the discharge wire with respect to the rear-front direction of the corona charger on the basis of a degree of the density gradation of the halftone image output by the image forming apparatus with respect to the rear-front direction.

However, in such an adjusting method, when the service person is unskilled, it takes much time to adjust the discharge wire height. Even in the case of adjusting the discharge wire height by a skilled service person, it was difficult to adjust the discharge wire height in one adjusting process so that the photosensitive drum was able to be uniformly charged. That is, the discharge wire height is determined by repeating the adjusting process, so that a long time is required in the wire height adjusting operation.

SUMMARY OF THE INVENTION

The present invention has been accomplished in view of the above-described problems.

A principal object of the present invention is to provide an image forming apparatus capable of easily performing a discharge wire height adjusting operation of a corona charger in a short time without requiring a skill in judging an adjusting amount.

According to an aspect of the present invention, there is provided an image forming apparatus comprising:

a photosensitive member;

a corona charger provided with a discharging wire for electrically charging the photosensitive member;

exposure means for exposing to light the photosensitive member charged by the corona charger to form an electrostatic image on the photosensitive member;

developing means for developing the electrostatic image with toner to form a toner image on the photosensitive member;

transfer means for transferring the toner image from the photosensitive member onto a sheet;

adjusting means for adjusting a distance from the discharging wire to the photosensitive member;

detecting means for detecting information corresponding to a surface potential of the photosensitive member at least two points, along a longitudinal direction of the corona charger, in an area in which the photosensitive member is charged by the corona charger; and executing means for executing an adjusting mode in which a reference mark for positioning the sheet at a reference portion extending along a longitudinal direction of the corona charger and an adjusting mark for adjusting the distance from the charging wire to the photosensitive member over the longitudinal direction of the corona charger on the basis of an output of the detecting means are formed on the sheet.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the image forming apparatus according to the present invention will be described more specifically.

Embodiment 1

First, a schematic constitution of the image forming apparatus will be described and then a constitution of the corona charger will be described. Thereafter, an output procedure of an image for adjusting the discharge wire height and an adjusting method using the image will be described.

The schematic constitution of the image forming apparatus and an image forming operation will be described.

(Image Forming Apparatus)

Figure 1:
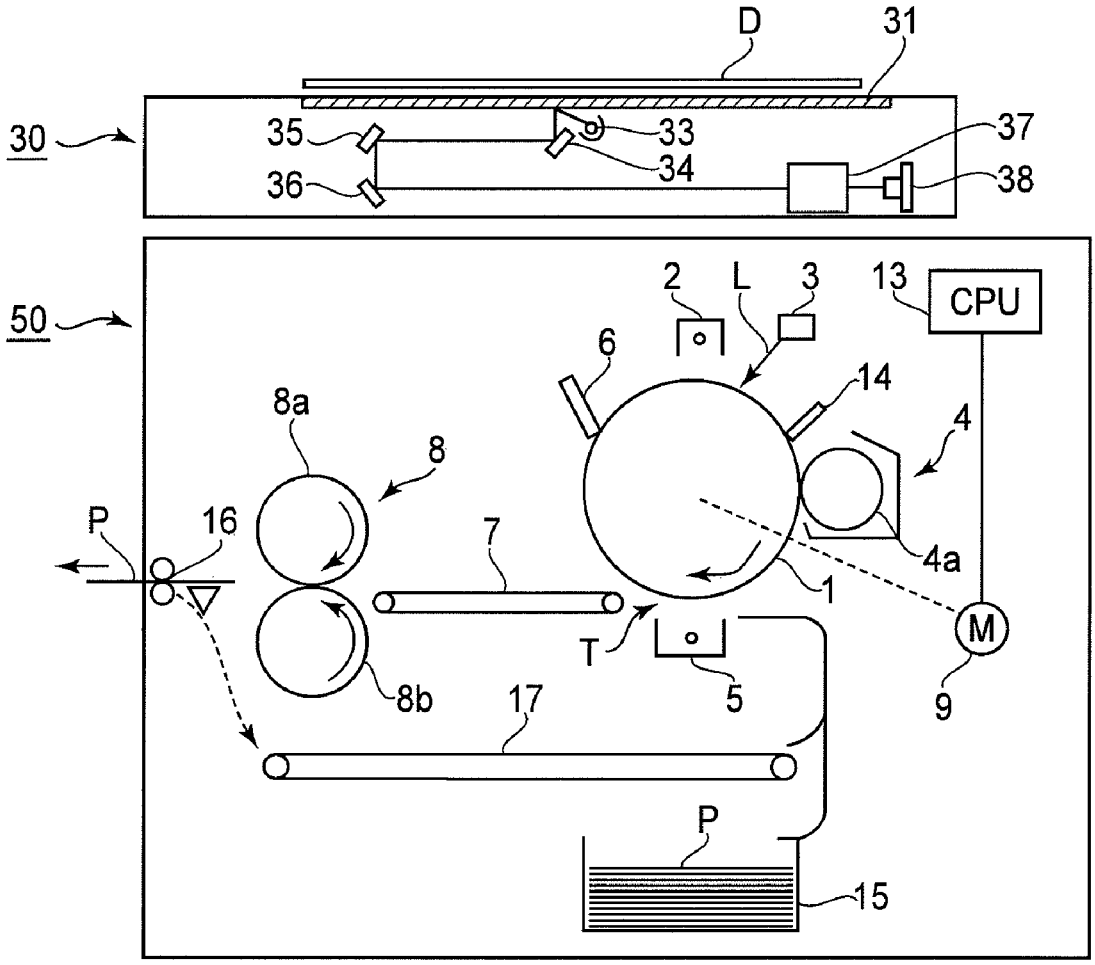
FIG. 1 is a schematic view for illustrating a constitution of the image forming apparatus according to the present invention.

FIG. 1 shows the schematic constitution of the image forming apparatus in this embodiment. In this embodiment, the image forming apparatus is a digital copying machine utilizing an electrophotographic process. Here, as a specific example, the image forming apparatus as the copying machine for forming the image by reading the image on an original. In this embodiment, the image forming apparatus includes an image reading portion (reader portion) 30 for generating image data by reading an original D through optical scanning and includes an image forming portion 50 for recording the image data on a recording material (sheet) by an electrostatic method.

Here, the original D is placed on a platen glass 31 in a state in which a reading surface is directed downward, and an optical system effects reading by scanning along the platen glass 31. At this time, an original surface of the original D is irradiated with light from a light source 33 and reflected light forms an image on a light-receiving surface of a CCD 38 as a photoelectric conversion means through mirrors 34, 35 and 36 and an image forming optical system 37.

In this embodiment, the image reading portion 30 as an original reading means for reading image information of the original is constituted by an optical system including the light source 33, the mirrors 34, 35 and 36, the image forming optical system 37, and the CCD 38 and an unshown optical system driving means. The image data of the original D read by the image reading portion 30 is sent from the CCD 38 to an unshown image processing portion by which the image data is processed and is sent to the image forming portion 50 as an image signal.

The image forming portion 50 includes an a-Si photosensitive drum 1 as an image bearing member to be rotationally driven in an indicated arrow direction (clockwise direction). Around the photosensitive drum 1, a charger (charging means) 2, an exposure device (exposure means) 3, a developing device (developing means) 4, a transfer device (transfer means) 5, a cleaning blade (cleaning means) 6, and the like are provided.

(Image Forming Operation)

Next, the image forming operation of the image forming apparatus will be described.

During both-side image formation, the photosensitive drum 1 is rotationally driven in the arrow direction (clockwise direction) at a predetermined speed (450 mm/sec in this embodiment) by a drum driving motor 9 and is uniformed charged by the charger 2 at its surface. Then the surface of the photosensitive drum 1 is exposed to laser light L depending on image information input from the exposure device 3, so that electric charges of an exposed portion are removed and an electrostatic image is formed. The electrostatic image is reversely developed by depositing toner by the developing device 4, thus being visualized as a toner image.

When the toner image on the photosensitive drum 1 reaches a transfer portion T between the photosensitive drum 1 and the transfer device 5, a recording material P such as a sheet fed from the inside of a recording material cassette 15 is conveyed to the transfer portion T by registration rollers (not shown) while being timed to the toner image. Then, the toner image is transferred onto a surface (one-side surface) of the recording material P by the transfer device 5.

The recording material on which the toner image is transferred on one side thereof is conveyed by a conveying device 7 to a fixing nip between a fixing roller 8*a* and a pressing roller 8*b* in a fixing device 8. The recording material P on which the toner image is transferred is heated and pressed in the fixing nip between the fixing roller 8*a* and the pressing roller 8*b*, thus being subjected to toner image fixation. Thereafter, the recording material P is conveyed onto a re-conveying belt 17 by reverse rotation of a reversing roller 16. Then, the recording material P conveyed on the re-conveying belt 17 is conveyed again to the transfer portion T between the photosensitive drum 1 and the transfer device 5, and is subjected to the image formation on the other side surface in the same manner a that described above and then is discharged to the outside of the image forming apparatus.

Transfer residual toner or the like remaining on the photosensitive drum 1 is removed and collected by the cleaning blade 6.

Further, during one-side image formation, the recording material P which has been subjected to one-side toner image fixation by the heat-pressing of the toner image by the fixing device in the same manner as that described above is discharged to the outside of the image forming apparatus by normal rotation of the reversing roller 16 without being conveyed onto the re-conveying belt 17.

Hereinbelow, the schematic constitution of the corona charger in this embodiment and a discharge wire adjusting mechanism will be described.

(Corona Charger)

Figure 2:
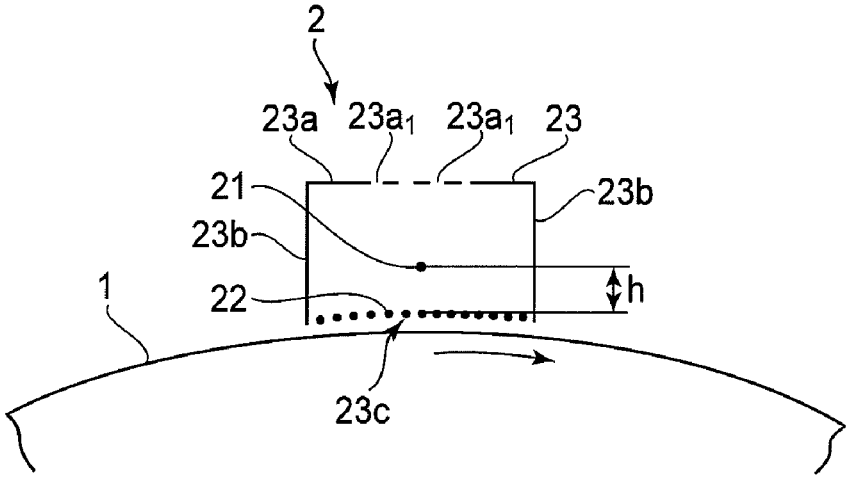
FIG. 2 is a sectional view of a corona charger.

In this embodiment, the corona charger 2 has a structure well-known by the person skilled in the art and includes a charger shield (casing) 23 as shown in FIG. 2, in which a tungsten wire having a diameter of about 40 μm to about 100 μm is stretched as the discharge wire 21. The casing 23 haws a bottom surface 23*a* and both side surfaces 23*b* and is provided with an opening 23*c* at a position opposite to the bottom surface 23*a*. The casing 23 has a U-shape in cross section and the opening 23*c* thereof also opposes the photosensitive drum 1. Further, in this embodiment, the bottom surface of the corona charger 2 is provided with a plurality of (e.g., two to four) slot-like openings 23*a*1 along a longitudinal direction of the corona charger 2. These openings 23*a*1 will be described later more specifically but is usable for permitting insertion of an adjusting sheet P, as the recording material on which an image for adjusting the height of the discharge wire 21 is formed, into the corona charger 2.

In this embodiment, the corona charger 2 is of a scorotron type and is provided with a grid 22 at the opening 23*c*. The grid 22 is formed with an electroconductive member (such as SUS 304, SUS430 or another electroconductive material) having a diameter of 50-200 μm. A voltage to be applied to the discharge wire 21 is 10 kV as the maximum and a discharging operation is performed by applying the voltage to the discharge wire 21 so that the voltage corresponds to a current amount of 1100 μA.

By the above-described corona charger 2, the photosensitive drum 1 is charged in a range of 200 V to 600 V. In this embodiment, the current amount of the discharge wire 21 of the corona charger 2 is 1100 μA and the bias of 800 V is applied to the grid 22, so that the photosensitive drum 1 is charged to have a dark portion surface potential Vd of 360 V.

When the thus uniformly charged photosensitive drum 1 is subjected to image exposure using laser light, a light portion potential is 50 V. Further, to a developing roller 4*a* in the developing device 4, a developing bias is applied. A DC component Vdc of the developing bias is set at 230 V.

(Discharging Wire Height Adjusting Mechanism)

Figure 3:
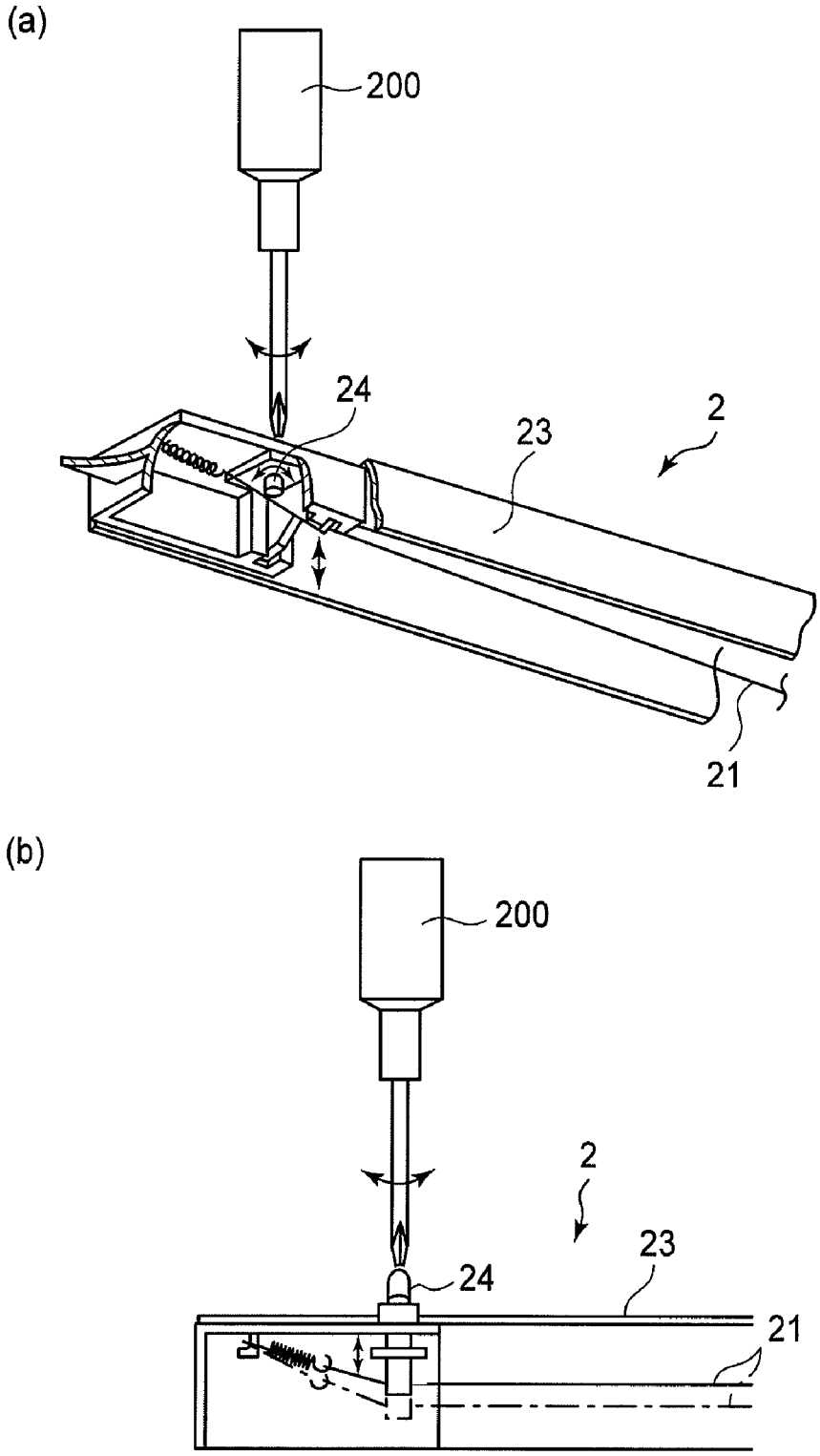
FIGS. 3(*a*) and 3(*b*) are a perspective view and a sectional view, respectively, for illustrating a discharge wire height adjusting operation.

A distance h between the discharge wire 21 and the grid 22 (hereinafter referred to as a wire height) can be changed by adjusting the height of the discharge wire 21 at a rear position and a front position of the discharge wire 21 with respect to the axis direction of the discharge wire 21. That is, the height of the discharge wire 21 is adjustable by an adjusting screw 23 as an adjusting means provided on each of one end side and the other end side of the corona charger 2 with respect to the longitudinal direction of the corona charger 2, i.e., at each of the rear and front positions of the corona charger 2 as shown in FIGS. 3(*a*) and 3(*b*). A service person can adjust the height of the discharge wire by turning the adjusting screw.

Figure 4:
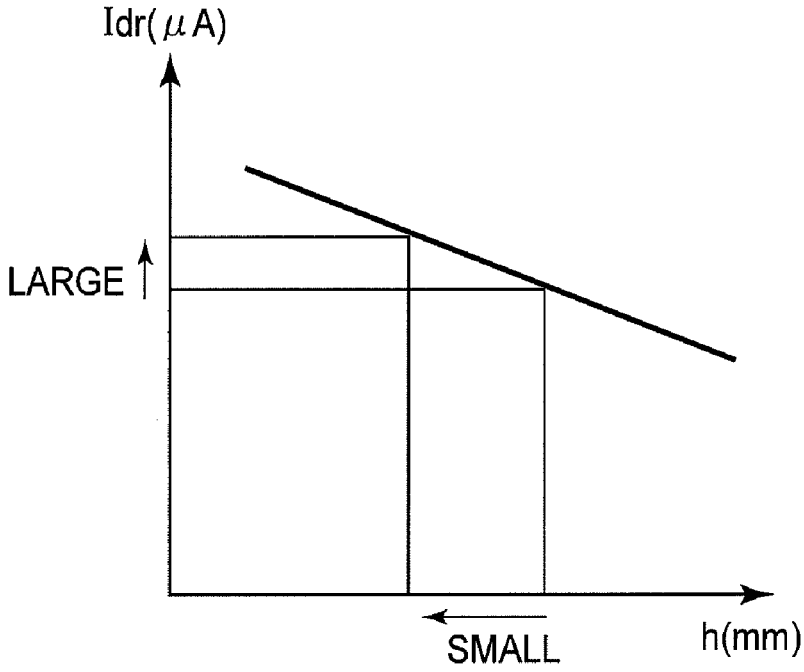
FIG. 4 is a graph showing a relationship between a discharge wire height and an amount of discharge current from a discharge wire to a photosensitive drum.
Figure 5:
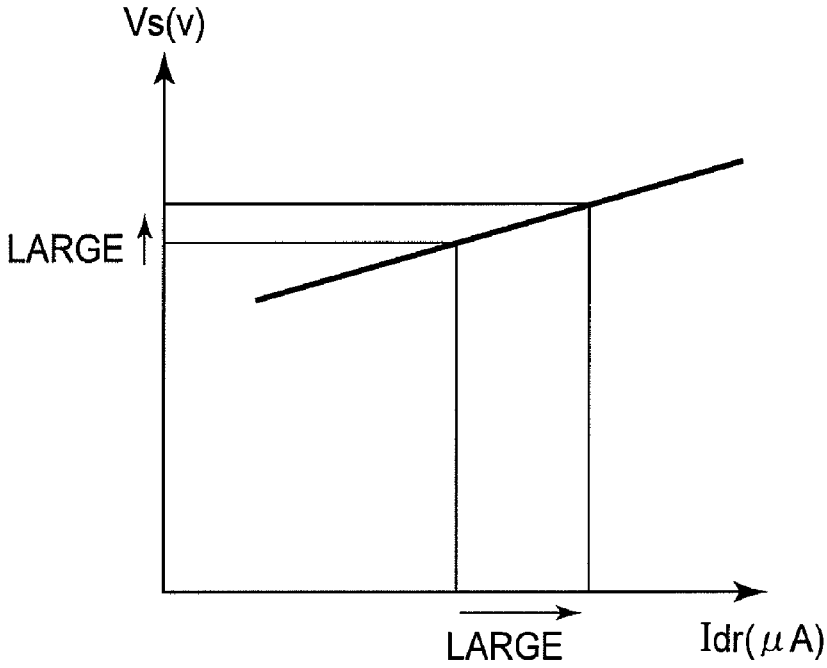
FIG. 5 is a graph showing a relationship between the discharge current amount and a surface potential of the photosensitive drum.

As shown in FIG. 4, when the height of the discharge wire 21 is decreased (the distance between the discharge wire 21 and the grid 22 is decreased, i.e., the distance between the discharge wire 21 and the photosensitive drum 1 is decreased), a discharge current amount Idr is increased. That is, in the case where the height of the discharge wire 21 is decreased, even when the current passing through the discharge wire 21 is constant (constant current), the current amount Idr of the discharge from the corona charger 2 to the photosensitive drum 1 is increased. Further, when the discharge current amount Idr is increased, a surface potential Vs of the photosensitive drum 1 is increased (FIG. 5). Thus, the surface potential Vs of the photosensitive drum 1 is changed by adjusting the wire height h of the corona charger 2.

Figure 6:
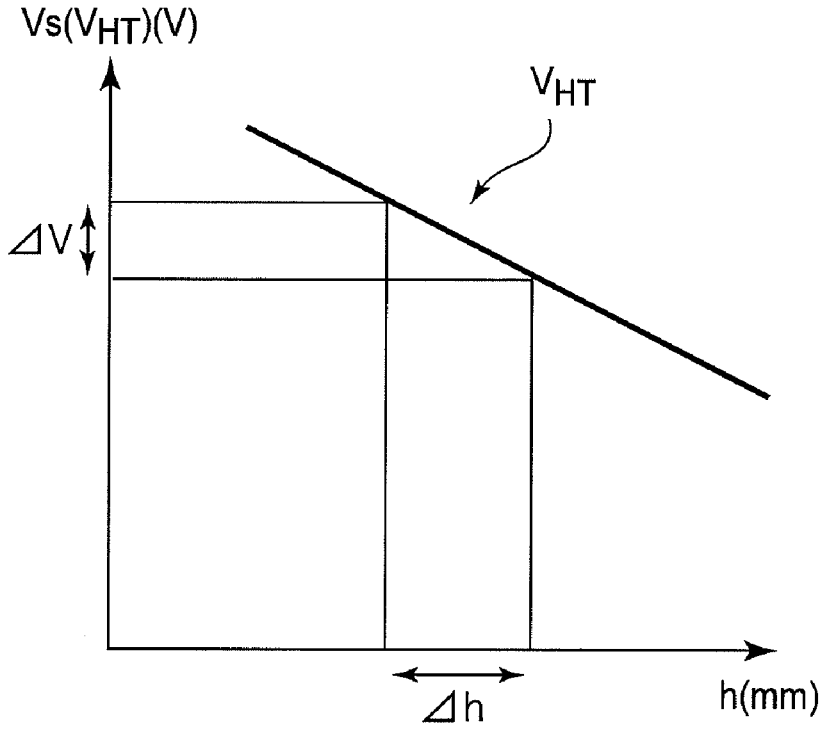
FIG. 6 is a graph showing a relationship between the discharge wire height and the surface potential of the photosensitive drum at a halftone image portion.

At the dark portion of the photosensitive drum 1, the surface potential Vs is changed by changing the wire height h. When the photosensitive drum 1 is charged and subjected to the image exposure under the same condition with respect to a grid bias and laser power, a drum surface potential VHT at a halftone portion is similarly changed as shown in FIG. 6.

The relationship between the wire height h and the surface potential VHT at the halftone portion (FIGS. 4, 5, 6 and 7) is stored in a memory in a main assembly of the image forming apparatus.

The wire height adjusting procedure in this embodiment will be described. First, in order to adjust the wire height, the service person outputs the halftone image on the sheet by operating the image forming apparatus. Then, the service person causes the image forming apparatus to read the output halftone image with the scanner. The image forming apparatus calculates the density gradation on the basis of the read image and densities at least two points with respect to the longitudinal direction of the corona charger (the photosensitive drum generating line direction). Incidentally, in the case of detecting the inclination of the discharge wire, it is possible to detect the inclination of the discharge wire with high accuracy when the distance between the two points at which the density is measured is increased. For that reason, in this embodiment, the image for adjusting the discharge wire inclination is output on the basis of the densities of the output halftone image at longitudinal right and left end portions.

Hereinafter, a control circuit of the image forming apparatus will be described and then a general outline of the adjusting procedure and processing for outputting the image for adjustment will be described along a flowchart.

(Control Circuit)

Figure 8:
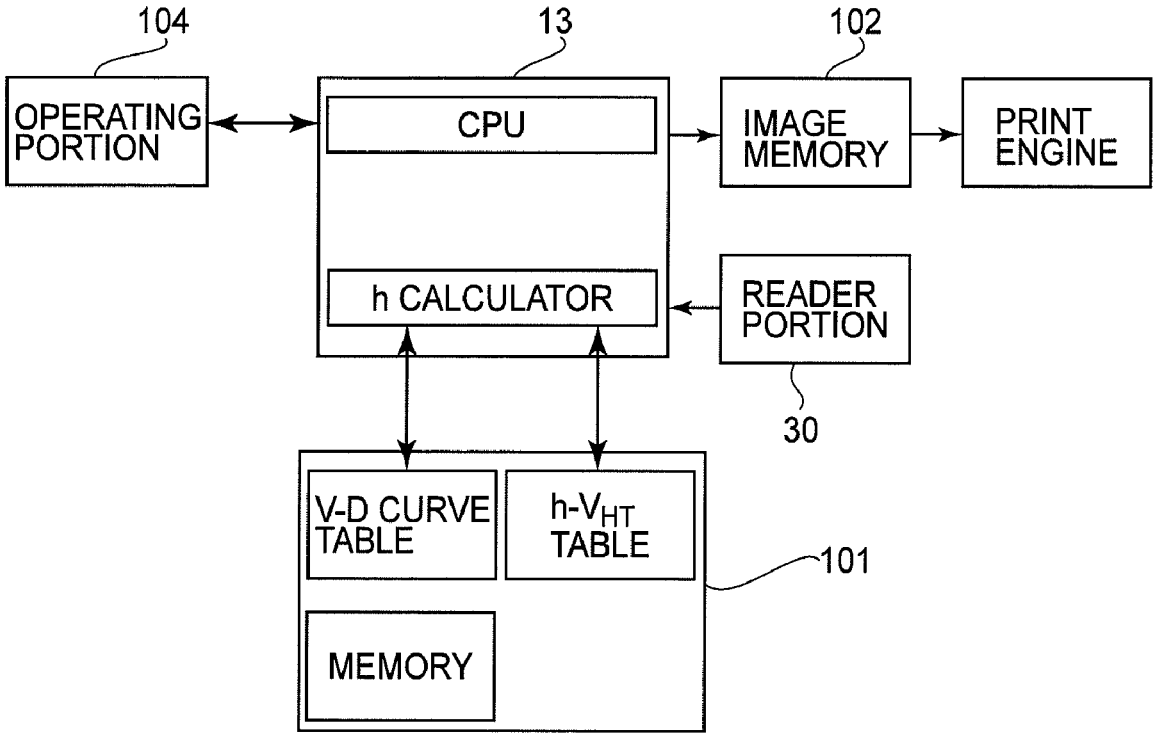
FIG. 8 is a block diagram for illustrating a hardware configuration of the image forming apparatus.

FIG. 8 is a block diagram for illustrating the control circuit for controlling respective portions of the image forming apparatus in this embodiment. The control circuit in this embodiment controls the respective portions of the image forming apparatus by using a CPU 13 as a control means in accordance with a program stored in a memory 101. Further, the image forming apparatus includes an image memory 102, the reader portion 30 and an operating portion 104.

In this embodiment, the memory portion 101 in the main assembly stores, as a table, the relationship between the wire height h and the surface potential VHT of the photosensitive drum at the halftone portion. Further, the memory portion 101 also stores a V-D curve table. The main assembly CPU 13 as a calculating means (wire height calculating portion) calculates the wire height by making reference to the table stored in the memory.

Further, the relationship between the wire height h and the surface potential Vs (VHT) at the halftone portion varies every photosensitive drum, particularly in the case of using the a-Si photosensitive drum. Therefore, during drum exchange, the service person inputs, from the operating portion 104, data (at several points) of the relationship between the wire height h and the surface potential VHT of the photosensitive drum at the halftone portion attached to a new (fresh) photosensitive drum. Further, in the memory 101 in the main assembly, a relationship between a surface potential Vsd of the photosensitive drum (a difference between the drum surface potential and the developing bias Vdc) and the image density D as shown in FIG. 7 is stored in advance.

Figure 7:
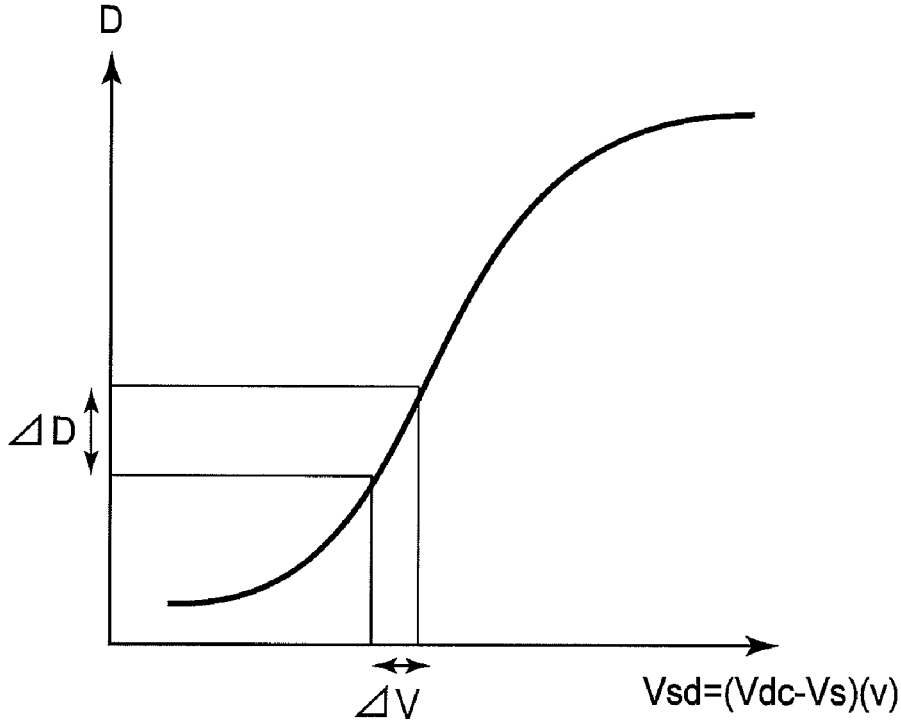
FIG. 7 is a graph showing a relationship between the photosensitive drum surface potential (a difference between the photosensitive drum surface potential and a developing bias) and an image density.

Incidentally, it is also considered that a relationship table between the wire height h and the photosensitive drum surface potential VHT at the halftone portion shown in FIG. 6 and a relationship table between the photosensitive drum surface potential Vsd and the image density D shown in FIG. 7 are collectively stored as one table. However, with respect to the digital image forming apparatus utilizing the electrophotographic process, in order to correct the gradation property of the image to be output, the relationship table between the photosensitive drum surface potential and the image density shown in FIG. 7 is generally used in many cases. For that reason, in this embodiment, the above relationship tables are separately stored on purpose in the main assembly memory as two tables, so that the relationship table between the photosensitive drum surface potential Vsd and the image density D is caused to function as that for during the adjustment of the wire height h and that for during the correction of the image gradation property.

(Wire Height Adjusting Procedure)

Figure 13:
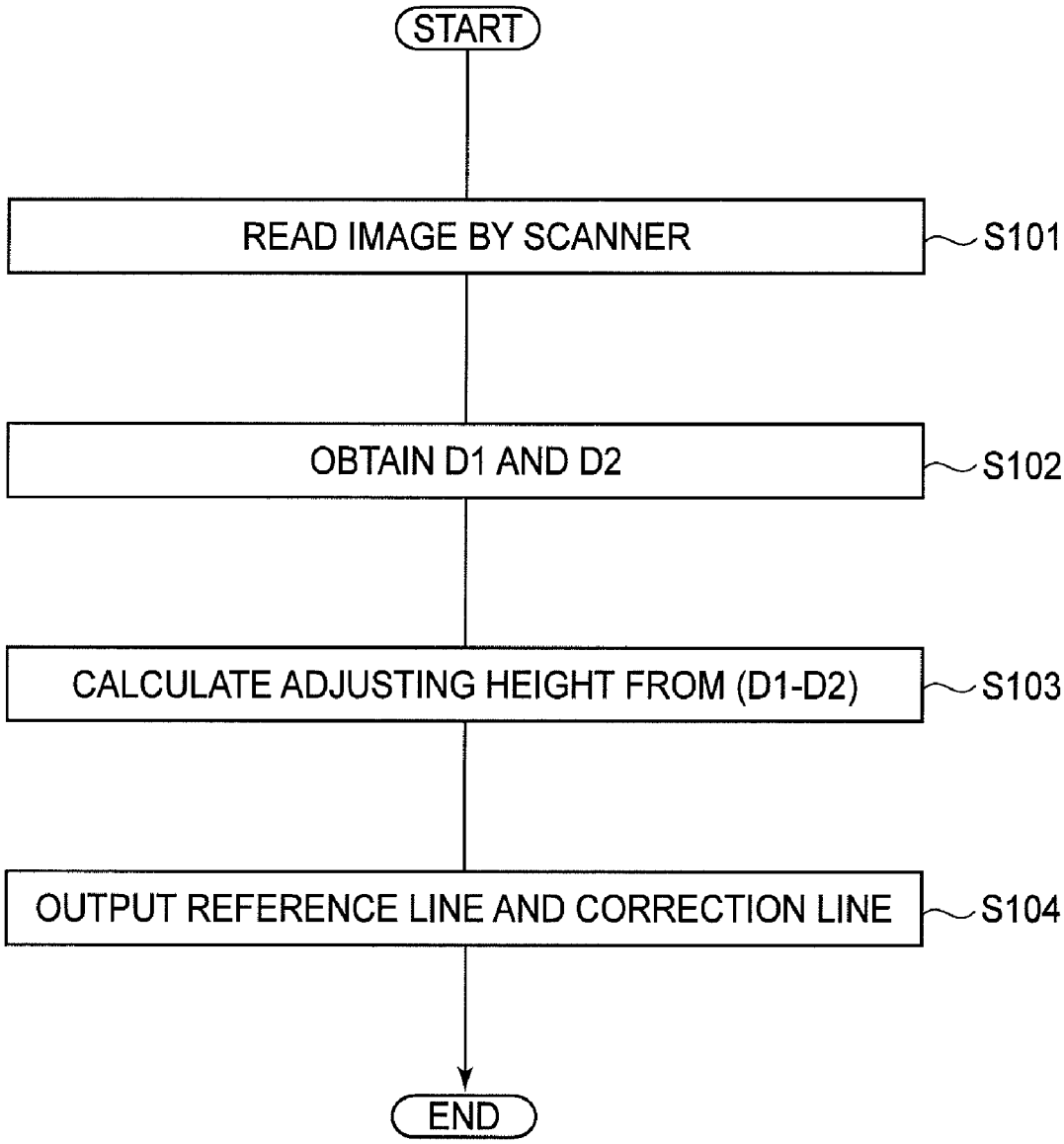
FIG. 13 is a flowchart for illustrating processing during the output of the reference line and an adjusting line on the sheet.

The image forming apparatus in this embodiment includes the executing means (CPU) for executing the adjusting mode in which the wire height is adjusted. That is, in the adjusting mode, a reference mark for positioning the adjusting sheet P at a reference portion along the longitudinal direction of the corona charger 2 and an adjusting mark for adjusting the distance from the discharge wire 21 to the photosensitive drum 1 over the longitudinal direction of the corona charger 2 are formed on the adjusting sheet P and then the adjusting sheet P is discharged. Hereinafter, an operation of the service person (step 1), an adjusting operation (step 5) and operations of the image forming apparatus (steps 2 to 4) will be described in detail. An operation of the image forming apparatus from completion of the reading of the adjusting sheet P until the output of the image for the wire height adjustment will be described along a flowchart shown in FIG. 13.

(Step 1)

When the wire height adjustment is performed, the service person selects the wire height adjusting mode at the operating portion 104. By receiving instructions from the service person, the image forming apparatus outputs the halftone image on a recording sheet (paper) on the basis of data stored in the image memory 102 in the main assembly of the image forming apparatus. As a result, the adjusting sheet for adjusting the height of the discharge wire is output. The output halftone image is used for the purpose of adjusting the wire height of the corona charger. For this reason, it is preferable that the image is output by adjusting an image forming condition (charging condition, developing condition) without subjecting the photosensitive member to the image exposure. Especially, when the image forming condition is changed to that under which is relationship between a constant potential and the image density (so-called γ LUT) provides an abrupt gradient in the halftone area, accuracy with which the density gradation of the discharge wire is calculated is preferably improved.

(Step 2)

The service person operates the reader portion 30 as the original reading portion so that the reader portion 30 reads the adjusting sheet output in Step 1. As a result, the CPU as the control means obtains the image read by the reader portion 30 (scanner) (S101 in FIG. 13). Thus, the reader portion 30 (scanner) functions as the detecting means for detecting information corresponding to potentials of the photosensitive member (photosensitive drum 1) on both longitudinal end sides of the corona charger 2 in a charged area of the photosensitive drum 1 by the corona charger 2.

In this embodiment, the information corresponding to the potentials of the photosensitive member is an optical density obtained by converting a luminance signal from the reader portion 30. This is because it is possible to calculate the drum surface potential from the obtained optical density on the basis of the relationship table between the drum surface potential (the difference between the drum surface potential and the developing bias) Vsd and the density level D. Thus, the photosensitive member surface potential corresponding to the optical density can be obtained from the optical density. Therefore, the optical density is referred to as the information corresponding to the surface potential of the photosensitive member.

Incidentally, in this step, the difference between charge potentials due to the inclination of the discharge wire is only required to be detected, so that the detection of the information corresponding to the potentials of the photosensitive drum at least two points in the areas in which the photosensitive drum is charged by the corona charger may only be required. There is the largest difference in height between the longitudinal one end and the longitudinal the other end of the corona charger in the charged area of the photosensitive drum when the discharge wire is inclined, it is preferable that the information corresponding to the potentials at the two points is obtained.

(Step 3)

The image forming apparatus obtains rear-side image density level and front-side image density level of the halftone image by converting the luminance signal obtained from the reader portion 30 into the density. The CPU 101 as the control means obtains, with respect to the read image, a density D1 at the left-side end portion in the charged area and a density D2 at the right-side end portion in the charged area (S102 in FIG. 13). The CPU (control device) 13 as the control means makes reference to the relationship table between the drum surface potential (the difference between the drum surface potential and the developing bias) Vsd and the density level D stored in the memory (hereinafter referred to as a "V-D curve"). The CPU 13 calculates the drum surface potential (the difference between the drum surface potential and the developing bias) Vsd corresponding to each of the rear-side image density level (D1) and the front-side image density level (D2) from the associated relationship table. Thereafter, the CPU 13 converts the drum surface potentials (the differences between the drum surface potential and the developing bias) Vsd on the rear and front sides) into the drum surface potentials Vs. A conversion formula in this case is Vsd=Vds−Vs where the drum surface potential is Vs and the DC component of the developing bias is Vdc. Further, the CPU 13 obtains a difference Δh in wire height corresponding to each at the drum surface potentials on the rear and front side on the basis of the transfer between the wire height h and the surface potential Vs (VHT) of the photosensitive drum at the halftone portion shown in FIG. 6 described above (S103 in FIG. 13). In this embodiment, the surface potential Vs (VHT) of the photosensitive drum at the halftone portion is the difference between the surface potential of the photosensitive drum and the developing bias Vdc.

For example, in the case where the front-side surface potential is lower than the rear-side surface potential by ΔV, in order to increase the front-side surface potential, an adjusting value and a height after the adjustment are calculated relative to the current wire height so that the front-side wire height is decreased by Δh. The current wire height has already been stored in the main assembly memory 101 from the time of factory shipment and has been updated every adjustment of the wire height h.

(Step 4)

On the basis of a calculation result obtained in Step 3, i.e., based on the rear-side wire height and the front-side wire height, the CPU 13 writes a reference mark Mo, in the image memory 102, located at a position from an end (edge) of the adjusting sheet by a certain distance (10 mm in this embodiment) with respect to a sheet conveying direction. That is, the reference mark Mo is used for positioning the adjusting sheet at the reference portion of the corona charger 2 with respect to the longitudinal direction of the corona charger 2. At the same time, the CPU 13 writes data in the image memory 102 as an image (FIG. 9) of an adjusting mark (correction mark) Mh for the wire height h at a position spaced from the reference mark Mo by a distance corresponding to the wire height at the rear and front end positions of the adjusting sheet with respect to the sheet conveying direction (S04 in FIG. 13). Incidentally, in FIG. 9, a line image is used as each of the marks.

The adjusting line (mark) Mh for the wire height h is printed on the adjusting sheet P so as to be spaced from the reference line (mark) Mo by the distance corresponding to the wire height at the rear and front end positions of the adjusting sheet. At a position other than the rear and front end positions (e.g., at a central position), the adjusting line Mh is written in the image memory 102 (FIG. 8) so that the adjusting line Mh is spaced from the reference line Mo by a distance corresponding to a wire height obtained by linear interpolation.

Figure 9:
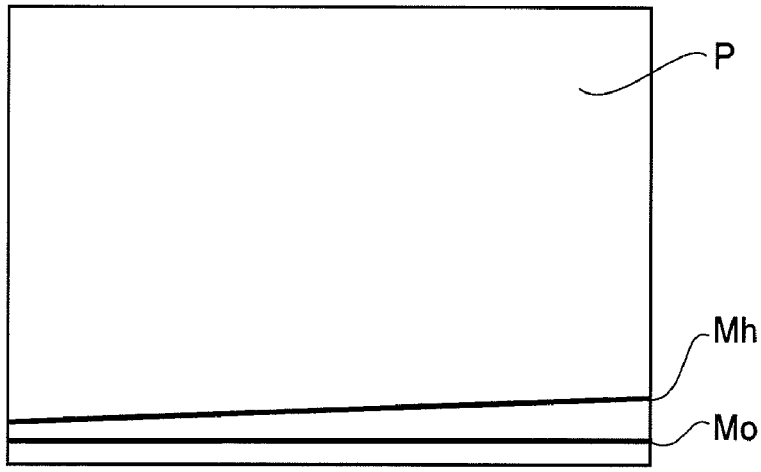
FIG. 9 is a schematic view showing an example of an image to be output for adjusting the discharge wire height.

After the image data for adjusting the wire height is written in the image memory 102, the service person presses a button of "image output for wire height adjustment" displayed at the operating portion 104, so that the image of the marks Mo and Mh as shown in FIG. 9 is output.

Figure 10:
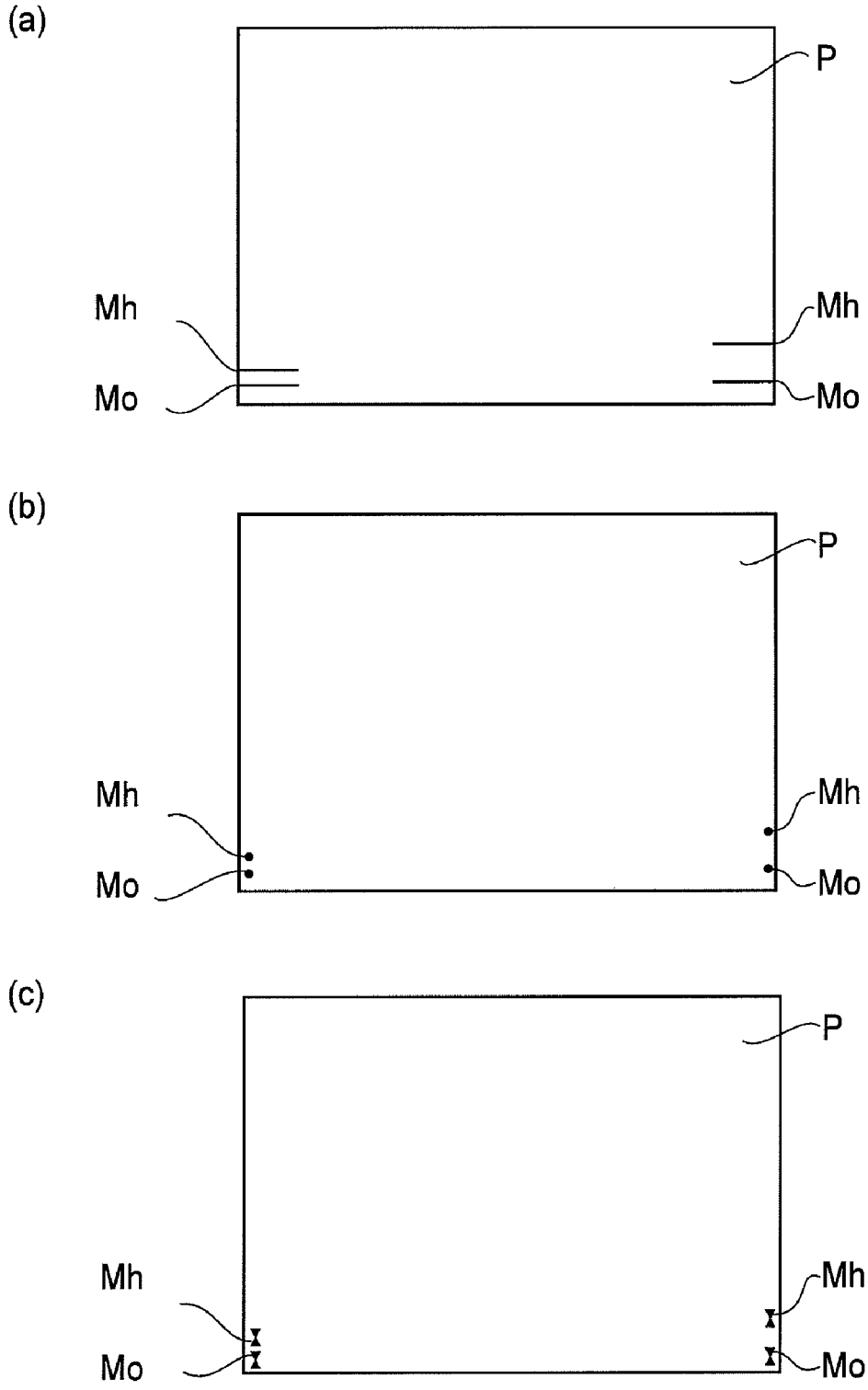
FIGS. 10(*a*), 10(*b*) and 10(*c*) are schematic views each showing an example of the first to be output for adjusting the discharge wire height.

Incidentally, the reference mark Mo and adjusting mark Mh of the image for adjusting the wire height may only be required to be located at least both end positions of the adjusting sheet P. Further, the reference mark Mo may have any shape so long as the adjusting sheet P can be positionally aligned with the corona charger 2, and the adjusting mark Mh may also have any shape so long as the height position of the discharge wire 21 can be defined. For example, as the marks Mo and Mh, it is also possible to use those in the shape of line segments at the both end portions as shown in FIG. 10(*a*), those in the shape of dots at the both end portions as shown in FIG. 10(*b*), and those in the shape of an hour-glass, including two triangles having an intersection indicating an associated position, as shown in FIG. 10(*c*).

(Step 5)

Figure 11:
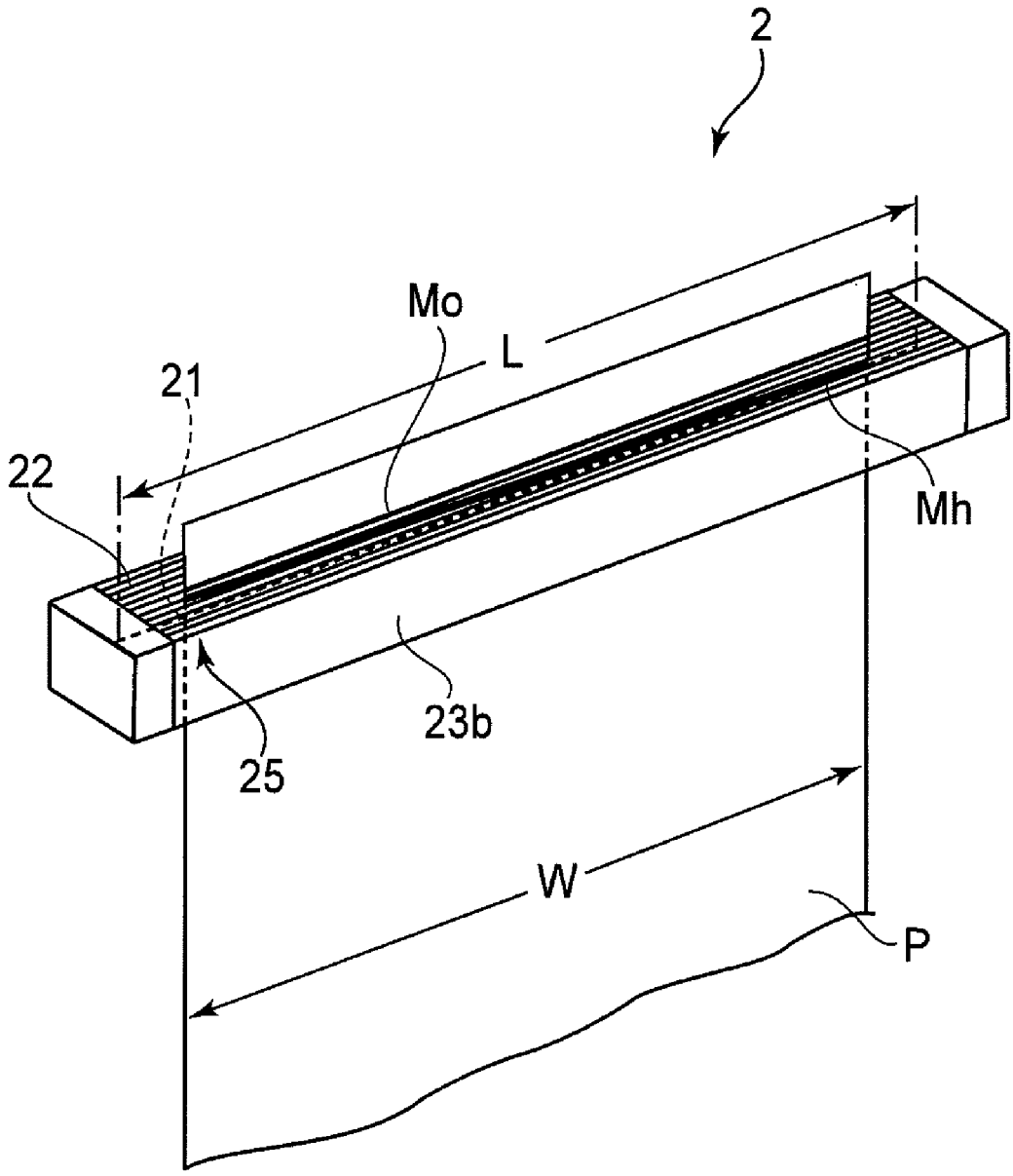
FIG. 11 is a schematic view showing an adjusting operation in which a reference line is aligned with a grid line by using an adjusting sheet on which an image output for adjusting the discharge wire height is printed.

The adjusting sheet P output in Step 4 is adjusted by the service person so as to be aligned with an associated position of the corona charger 2. Specifically, as shown in FIG. 11, the service person inserts first the adjusting sheet P from a slot-like opening 23*a*1 provided at the bottom surface 23*a* of the corona charger 2 into the corona charger 2, so that the reference line Mo of the adjusting sheet P is positionally aligned with the grid line 22 of the corona charger 2 as the reference portion. Here, the position of the adjusting sheet P with respect to the rear-front direction may also be set at substantially center position with respect to the length of the discharge wire 21 in the rear-front direction. However, it is preferable that the adjusting sheet P is set (positioned) so that one end portion of the adjusting sheet P is positionally aligned with a sheet position index 25 provided on a side surface 23*b* of the casing 23 of the corona charger 2 with respect to the rear-front direction. However, the length L of the discharge wire 21 with respect to the rear-front direction of the discharge wire 21 is required to be longer than a maximum image width in the charged area of the photosensitive drum, so that the wire length L is larger than the sheet wire W of the adjusting sheet P.

Then, the service person adjusts the height of the discharge wire 21 so that the position of the discharge wire 21 is aligned with the wire height adjusting line Mh on the adjusting sheet P. This adjustment of the wire height can be performed by turning the adjusting screws provided at the rear and front end portions of the corona charger 2 as shown in FIGS. 3(*a*) and 3(*b*) by the service person with a driver 200.

Figure 12:
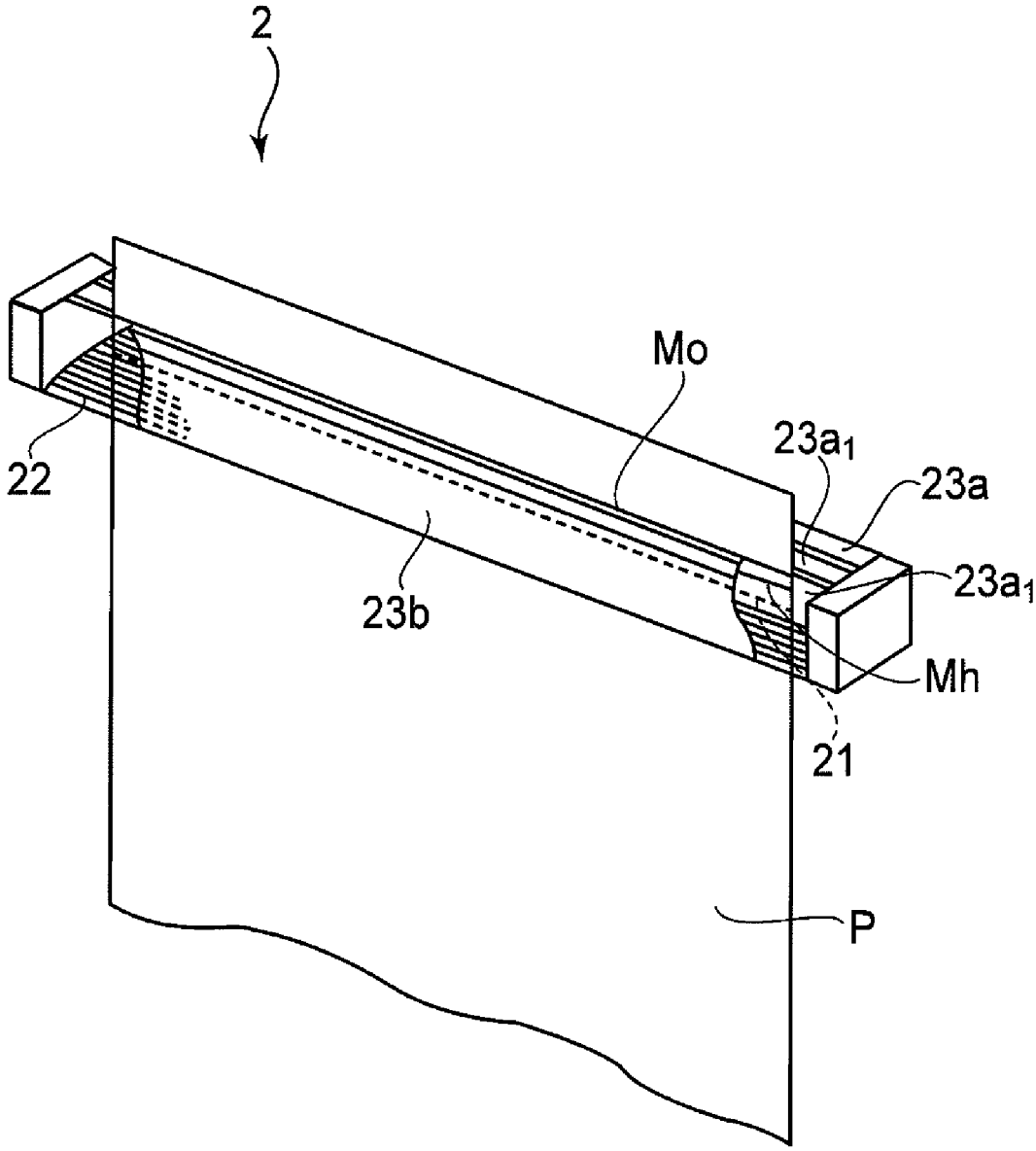
FIG. 12 is a schematic view showing the adjusting operation in which the reference line is aligned with the bottom of a casing of the corona charger by using the adjusting sheet on which the image output for adjusting the discharge wire height is printed.

Incidentally, in this embodiment, the wire height is adjusted by positionally aligning the reference line Mo with the grid line 22 as the reference portion but may also be adjusted by positionally aligning the reference line Mo with the bottom surface 23*a* of the casing 23 of the corona charger 2 as a modified embodiment as shown in FIG. 12.

In the modified embodiment, the calculation of the wire height adjusting line in Step 4 is performed by calculating the distance from the discharge wire 21 to the bottom surface 23*a* of the casing 23. The distance from the discharge wire 21 to the bottom surface 23*a* of the casing 23 is stored in advance in the main assembly memory 101.

As described above, in FIG. 12, the corona charger 2 provided with the opening 23*a*1 at the bottom surface 23*a* is shown. However, in the case of the corona charger having no opening at the bottom surface 23*a*, i.e., having a flat plate-like casing bottom surface, the adjusting sheet P is bent or cut with respect to the reference line Mo so that the reference line Mo is positionally aligned with the edge surface of the adjusting sheet P. By inserting the adjusting sheet P from the grid 22 side into the corona charger 2 until the reference line Mo abuts against the casing bottom surface 23*a*, the adjustment of the wire height can be performed.

As described above, according to this embodiment, with respect to the discharge wire height adjusting operation of the corona charger performed by the service person during the drum exchange or the like, the wire height is represented by the distance from the reference line Mo on the adjusting sheet (recording material) for service where the adjusting amount of the wire height is output. For that reason, the service person is not required to judge the wire height adjusting amount from the image density gradient, and accurate adjusting amount is calculated at a time. Therefore, there is no need to perform a try-and-error operation, so that a burden on the service person can be relieved. Further, during the wire height adjustment, the service person is only required to adjust the wire height position by positionally align the wire height position with the wire height adjusting line, so that there is no need to adjust the wire height with a ruler through eye observation and therefore the adjustment is easy.

Embodiment 2

In Embodiment 1, in Step 4, the wire height adjusting value is output on the adjusting sheet on which it is printed as the distance from the reference line Mo. In this embodiment, the wire height adjusting value may also be displayed (notification-provided) at the operating portion 104 as rear and front side adjusting values. In this case the adjusting operation performed in Step 5 in Embodiment 1 is changed as follows.

First, the service person reads the information corresponding to the rear and front side adjusting values displayed (notification-provided) at the operating portion 104, i.e., the wire height adjusting values (the distances from the grid line 22 in this embodiment). Then, the service person adjusts the wire height position with the ruler so that the distance from the discharge wire 21 to the grid line 22 coincide with an associated wire height position, on each of the rear side and the front side, displayed (notification-provided) at the operating portion. The heat adjusting operation is the same as that in Embodiment 1.

The wire height can also be represented by the distance from the discharge wire 21 to the bottom surface 23*a* of the casing 23 similarly as in Embodiment 1, in addition to the height h from the grid line. According to this embodiment, in addition to the effect such that the service person is not required to judge the wire height adjusting amount from the image density gradient and that the accurate adjusting value can be calculated at a time and thus there is no need to perform the try-and-error operation, the following effect is achieved.

That is, in this embodiment, the adjusting sheet for service is not output but the wire height adjusting values are displayed (notification-provided) at the operating portion. Then, the service person performs the wire height adjustment with the ruler on the basis of the displayed result. As a result, it is possible to obviate an adjustment error due to distortion of the adjusting sheet for service. For that reason, compared with the constitution in Embodiment 1, although convenience is lowered, the wire height can be adjusted with high accuracy.

Embodiment 3

In Embodiments 1 and 2, the V-D curve data used in Step 3 has been stored in advance in the memory in the main assembly. In this embodiment, the V-D curve data is prepared during the wire height adjustment. In this case, steps, during the adjustment of the wire height, different from those in Embodiment 1 will be described.

(Step 1')

In addition to the halftone image, a gradation image changed in gradation level with respect to the sheet conveying direction (an image with 17 gradation levels changed from a solid white level to a solid black level at regular intervals) is output on the adjusting sheet P for the purpose of preparing the V-D curve. During the output of the gradation image, in the image forming apparatus, the drum surface potential with respect to the gradation image on the photosensitive drum is measured by the surface potential sensor (surface potential detecting means) 14 provided opposed to the photosensitive drum and is stored in the memory 101 in the main assembly.

(Step 2')

The halftone image and the gradation image which are output as a test image in Step 1' are read by the reader portion 30 as the image reading means in the main assembly.

(Step 3')

The main assembly obtains not only the rear and front side density levels of the halftone image but also the density levels of the gradation image at the respective gradation levels by converting luminance signals obtained from the reader portion 30 into densities. The CPU 13 in the main assembly associates the drum surface potential data (obtained in Step 1') with respect to the gradation image at each of the gradation levels with the above-obtained density level. Here, the drum surface potential data is associated after being converted into the drum surface potential (the difference between the drum surface potential and the developing bias) Vsd according to the following equation:

$$Vsd=Vdc-Vs,$$

wherein Vdc represents the DC component of the developing bias and Vs represents the drum surface potential.

On the basis of the thus obtained data by associating the drum surface potential (the difference between the drum surface potential and the developing bias) Vsd at each gradation level with the density level D, the V-D curve is prepared and data thereof is stored in the memory 101 in the main assembly.

Then, the CPU 13 in the main assembly makes reference to the V-D curve and associates each of the rear and front side density levels of the halftone image with the drum surface potential (the difference between the drum surface potential and the developing bias).

Thereafter, the process in which the drum surface potential (the difference between the drum surface potential) with respect to the halftone image on each of the rear side and the front side is associated with the drum surface potential Vs and the process in which the drum surface potential Vs is associated with the wire height are the same as those in Step 3 in Embodiment 1.

Further, Steps 4 and 5 in this embodiment are also the same as those in Embodiment 1.

According to this embodiment, every adjustment of the wire height, the relationship table between the drum surface potential and the image density is prepared. Therefore, in addition to the effect described in Embodiment 1, it is possible to obviate factors such as a change with time of the relationship between the drum surface potential and the image density and a change in environment. Further, the high-accuracy relationship table between the drum surface potential and the image density is prepared, so that the wire height can be adjusted with high accuracy.

Embodiment 4

Figure 14:
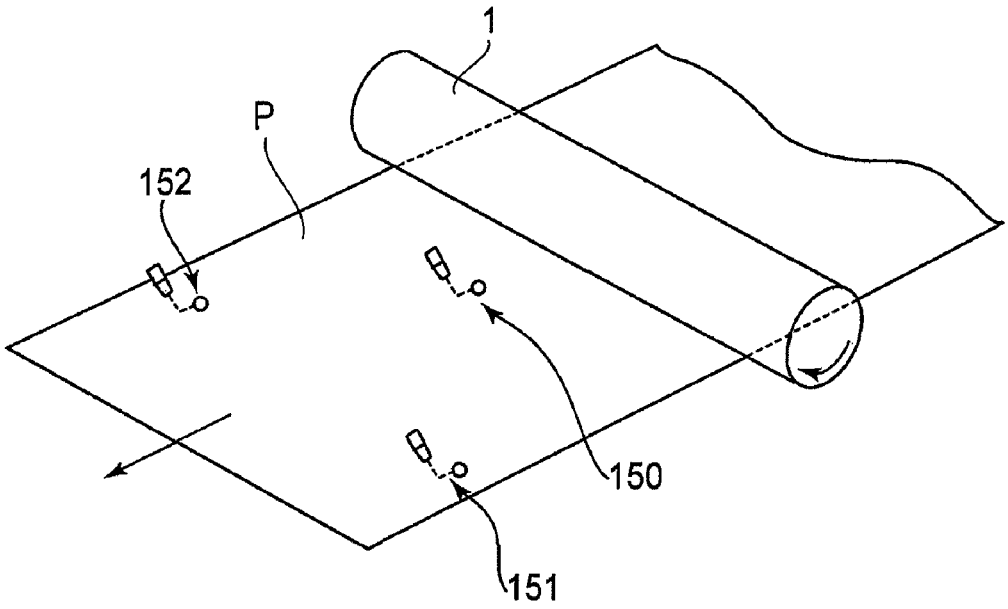
FIG. 14 is a schematic view for illustrating a density sensor disposed in the image forming apparatus.
Figure 15:
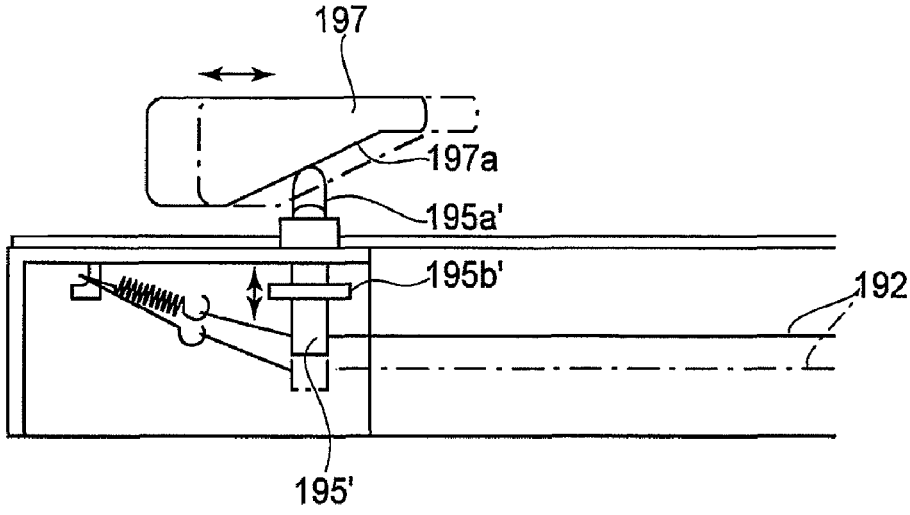
FIG.15 PRIOR ART
FIG. 15 is a schematic view for illustrating the discharge wire height adjustment in a conventional corona charger.

In Embodiments 1 and 2, the reader portion 30 is used as the original reading means for reading the output halftone image. In this embodiment, as shown in FIG. 14, image density sensors 151 and 152 for detecting the density of an image formed on a transfer sheet (paper) in the main assembly are provided on the rear side and the front side, respectively. The image density gradient is discriminated by a density signal level sent from the associated one of the sensors 151 and 152.

In Embodiment 3, the reader portion 30 in the main assembly is used when the gradation image is read. In this embodiment, an image density sensor 150 is provided at a central portion as shown in FIG. 14, so that the density level of the gradation image is detected.

In this embodiment, the image forming apparatus includes the image density sensor for detecting the image detect of the gradation image and includes the surface potential sensor 14. In this embodiment, the relationship table between the photosensitive drum surface potential and the image density can be prepared on the basis of the detection result of the image density of the gradation image by the image density sensor and the detection result of the drum surface potential with respect to the gradation image by the surface potential sensor.

Further, in this embodiment, the present invention is also applicable to a single function printer (SFP) in which the rear portion 30 is not mounted in the main assembly.

In the above-described embodiments, the image forming apparatus of the type in which the toner image formed on the image bearing member is directly transferred onto the recording material, i.e., of a so-called direct transfer type is described. However, the present invention can also be applied to the image forming apparatus of the type in which the toner image formed on the image bearing member is transferred onto an intermediary transfer member and then is transferred onto the recording material, i.e., of a so-called intermediary transfer type. The constitution of the image forming apparatus of the intermediary transfer type is well known by the person skilled in the art, thus being omitted from description.

Incidentally, in Embodiment 4, when the image forming apparatus is of the intermediary transfer type, it is also possible to detect the density of the toner image transferred from the image bearing member to the intermediary transfer member.

Here, when the height of the discharge wire with respect to the rear-front direction of the corona charger is changed, the distance from the discharge wire to the photosensitive drum is changed. For that reason, the amount of discharge current flowing from the corona charger to the photosensitive drum is changed, so that the surface potential of the photosensitive drum is changed along the rear-front direction of the photosensitive drum.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 146817/2009 filed Jun. 19, 2009 and 135537/2010 filed Jun. 14, 2010, which are hereby incorporated by reference.

What is claimed is:

1. An image forming apparatus comprising:

a photosensitive member;

a corona charger, detachably mountable to said image forming apparatus, provided with a discharging wire for electrically charging said photosensitive member and provided with an adjusting mechanism capable of adjusting a position of said discharging wire in a state in which said corona charger is demounted from said image forming apparatus;

an exposure device configured to expose light to said photosensitive member charged by said corona charger to form an electrostatic image on said photosensitive member;

a developing device configured to develop the electrostatic image with toner to form a toner image on said photosensitive member;

a transfer device configured to transfer the toner image from said photosensitive member onto a sheet;

a detecting device configured to detect information corresponding to a surface potential of said photosensitive member at least two points, along a longitudinal direction of said corona charger, in an area in which said photosensitive member is charged by said corona charger; and an executing device configured to execute an operation in a mode in which an image, including a reference mark positioned at a reference portion along the longitudinal direction of said corona charger, used for adjusting the position of said discharging wire by said adjusting mechanism, and including an adjusting mark for adjusting a distance of said discharging wire from said photosensitive member along a longitudinal direction of said photosensitive member, is outputted on the sheet, wherein a positional relationship between the reference mark and the adjusting mark is determined on the basis of a detection result of said detecting device.

2. The image forming apparatus according to claim 1, wherein said executing device outputs, during execution of the operation in the adjusting mode, an image to be formed on a whole surface of the sheet at a uniform density, and wherein said detecting device detects the density of the image outputted on the sheet at least two points.

3. The image forming apparatus according to claim 2, further comprising an original reading device configured to read image information of an original, wherein said original reading device functions as said detecting device.

4. The image forming apparatus according to claim 1, wherein each of the reference mark and the adjusting mark is a line image.

* * * * *